US005849675A

United States Patent [19]

Brown et al.

[11] Patent Number: 5,849,675

[45] Date of Patent: Dec. 15, 1998

[54] HYDRAULIC SYSTEM USING AN IMPROVED ANTIWEAR HYDRAULIC FLUID

[75] Inventors: Stuart H. Brown, San Rafael; Todd Brookhart, Walnut Creek, both of Calif.

[73] Assignee: Chevron Chemical Company, San Ramon, Calif.

[21] Appl. No.: 831,672

[22] Filed: Apr. 10, 1997

[51] Int. Cl.[6] ..... C10M 141/10

[52] U.S. Cl. ..... 508/199; 508/185; 508/283; 508/375; 508/378; 508/545; 508/558; 252/75

[58] Field of Search ..... 508/185, 199, 508/283, 375, 378, 545, 558; 252/75

[56] References Cited

U.S. PATENT DOCUMENTS

| | | | |
|---|---|---|---|
| 2,736,658 | 2/1956 | Pfohl et al. | 508/558 |
| 3,114,702 | 12/1963 | Thompson | 508/558 |
| 3,324,182 | 6/1967 | Brunner et al. | 508/558 |
| 3,843,542 | 10/1974 | Adams | 252/75 |
| 3,923,669 | 12/1975 | Newingham et al. | 252/75 |
| 4,094,800 | 6/1978 | Warne | 252/32.7 E |
| 4,210,541 | 7/1980 | Mann | 252/32.7 E |
| 4,210,542 | 7/1980 | Mann | 252/32.7 E |
| 4,439,336 | 3/1984 | Zaweski | 252/32.7 E |
| 4,462,918 | 7/1984 | Matthews et al. | 252/32.7 E |
| 4,530,771 | 7/1985 | Nakano et al. | 252/49.6 |
| 4,622,157 | 11/1986 | Peeler | 252/32.7 E |
| 4,683,069 | 7/1987 | Brewster et al. | 252/32.7 E |
| 5,352,377 | 10/1994 | Blain et al. | 252/51.5 R |

FOREIGN PATENT DOCUMENTS

| | | |
|---|---|---|
| 5 925 890 | 2/1984 | Japan . |
| 5 331 477 | 12/1993 | Japan . |

*Primary Examiner*—Jerry D. Johnson
*Attorney, Agent, or Firm*—Ernest A. Schaal

[57] ABSTRACT

A hydraulic system containing a piston-type pump having wear surfaces containing copper or a copper alloy, and, optionally, a vane-type pump having wear surfaces containing steel, uses an antiwear hydraulic fluid having an oil of lubricating viscosity and minor amounts of zinc dithiophosphate and a wear moderating agent. The wear moderating agent can be aliphatic polyol esters, boric acid derivatives of aliphatic polyol esters, aliphatic amines, aliphatic polyamines, aliphatic imidazolines, or mixtures of any combination thereof. The aliphatic groups of the wear moderating agent are substantially straight-chained, and the wear moderating agent contains at least ten carbon atoms.

16 Claims, No Drawings

HYDRAULIC SYSTEM USING AN IMPROVED ANTIWEAR HYDRAULIC FLUID

The present invention relates to a hydraulic fluid that imparts improved wear protection to piston pumps.

BACKGROUND OF THE INVENTION

Hydraulic fluid systems are employed in both mobile and stationary equipment. These systems comprise hydraulic cylinders, valves, pumps, lines, filters, and reservoirs. The pumps pressurize hydraulic fluid to actuators, motors, and/or hydraulic cylinders to provide both motion and positional control of machinery parts. In many systems, the hydraulic fluids also function as lubricants to provide wear protection.

Pumps in high pressure systems are generally of two types, rotary vane pumps and/or axial piston pumps. High pressure vane pumps require a hydraulic fluid with antiwear properties and oxidative stability. These properties are commonly achieved through the use of zinc dithiophosphates in the hydraulic fluids. Piston-type pumps require additives for rust-inhibition and oxidation-inhibition, but do not require the use of zinc dithiophosphates. On the contrary, it has been found that fluids containing zinc dithiophosphate can be detrimental to sliding steel-copper alloy interfaces in some piston pumps. In some cases, this has led to early, catastrophic failure of these pumps.

One solution for this has been to develop separate lubricant compositions for high pressure hydraulic piston pumps and vane pumps. These separate compositions are not satisfactory for both types of pumps. Vane pumps require lubricants containing antiwear agents, such as zinc dithiophosphates, which, however, corrode the copper alloy parts of a piston pump. Rust- and oxidation-inhibited oils are satisfactory for use in piston pumps but do not contain additives with sufficient surface reactivity to prevent wear of steel parts in vane pumps.

A second solution has been to develop a fluid that gives marginal performance in both types of pumps. There has been a long-felt need for a more robust single hydraulic pump lubricant, especially for those applications in which both types of pumps draw their lubricant from the same sump.

An example of this second solution is disclosed by Peeler in U.S. Pat. No. 4,622,157 entitled "Hydraulic Fluid System With Piston And Vane Pumps." Peeler discloses using a hydraulic fluid having an oil of lubricating viscosity, a zinc dithiophosphate, and a sulfurized ester-olefin, in an application where both types of pumps draw their lubricant from the same sump. While this hydraulic fluid is useful for both types of pumps, the combination of zinc dithiophosphate and sulfurized ester-olefin may degrade the thermal stability of the hydraulic fluid.

Japanese Patent Hei 5-331477 (1993) to Tonen Co., Ltd. discloses a hydraulic oil composition especially directed at power steering fluid, containing (a) from 0.1 to 7 weight % of one or a mixture of zinc dithiophosphate, phosphite ester, and phosphate ester, and (b) from 0.02 to 3 weight % of glycerol fatty acid esters. The purpose of the glycerol esters is to reduce friction. The Japanese patent publication does not teach or suggest using its hydraulic oil composition in hydraulic systems having both rotary vane pumps and axial piston pumps.

U.S. Pat. No. 4,210,541 entitled "Stabilized Hydraulic Fluid Composition," discloses an antiwear hydraulic oil comprising (a) a base oil, (b) from 0.1 to 2.0 volume % of $C_4$–$C_{12}$ zinc bis(dialkyldithiophosphate), (c) from 0.01 to 1.0 volume % of metal dialkylnaphthalene sulfonate; and (d) from 0.01 to 1.0 weight % of a fatty acid imidazoline. This patent does not teach or suggest using its hydraulic oil composition in hydraulic systems having both rotary vane pumps and axial piston pumps.

U.S. Pat. No. 4,210,542 entitled "Multicomponent Stabilized Hydraulic Fluid," discloses an antiwear hydraulic oil comprising (a) a base oil, (b) from 0.1 to 2.0 volume % of $C_4$–$C_{12}$ zinc bis(dialkyldithiophosphate), (c) from 0.01 to 1.0 volume % of metal phosphonate; and (d) from 0.01 to 1.0 weight % of a fatty acid imidazoline. This patent does not teach or suggest using its hydraulic oil composition in hydraulic systems having both rotary vane pumps and axial piston pumps.

U.S. Pat. No. 4,530,771 entitled "Lubricating Oil Compositions," discloses lubricant compositions containing borated glycerol esters to save fuel in crankcase engines. It does not teach hydraulic oil compositions.

SUMMARY OF THE INVENTION

The present invention provides an antiwear hydraulic fluid that can be used satisfactorily in both vane and piston pumps. That antiwear hydraulic fluid is used in a hydraulic system containing a piston-type pump having wear surfaces containing copper or a copper alloy, and, optionally, a vane-type pump having wear surfaces containing steel. In one embodiment, the hydraulic system contains both a piston-type pump and a vane-type pump, and the hydraulic fluid is drawn from a common sump. The present invention also provides a method of providing lubrication to both a piston-type pump and a vane-type pump, and is especially attractive for use in hydraulic systems comprising a combination of piston-type pumps and vane-type pumps.

The antiwear hydraulic fluid is useful in both types of pumps. It comprises a major amount of an oil of lubricating viscosity, a minor amount of at least one metal dithiophosphate; and a minor amount of a wear moderating agent. In an alternative embodiment, the antiwear hydraulic fluid can be produced by blending a major amount of an oil of lubricating viscosity, a minor amount of at least one metal dithiophosphate, and the wear moderating agent. Because the components may interact, the hydraulic fluid may contain one or more complexes or reaction products of the various components, together with unreacted components.

Normally, use of a metal dithiophosphate in the hydraulic fluid would lead to adhesive and/or corrosive wear of the copper alloy parts of a piston pump, but we have found that the presence of specific wear moderating agents allows the use of metal dithiophosphate without the normally associated wear problems.

Preferably the metal dithiophosphate is a zinc dialkyldithiophosphate, having alkyl groups containing less than nine carbon atoms. Preferably, the antiwear hydraulic fluid comprises from 2 to 10 mM/kg, more preferably from 4 to 6 mM/kg of the metal dithiophosphate. Preferably, the zinc dialkyldithiophosphate is derived from a primary alcohol that is branched on its beta-carbon, such as zinc di-2-ethylhexyidithiophosphate.

The wear moderating agent is selected from the group consisting of:

(1) aliphatic polyol esters, boric acid derivatives thereof, and mixtures thereof;

(2) a nitrogen-containing compound selected from the group consisting of aliphatic amines, aliphatic polyamines, aliphatic imidazolines, and mixtures thereof; and (3) mixtures of (1) and (2).

In each case of wear moderating agent, the aliphatic groups are substantially straight-chained, and the wear moderating agent contains at least ten carbon atoms. The aliphatic groups may be saturated or unsaturated, and they may be substituted or unsubstituted.

Preferably, the antiwear hydraulic fluid comprises from 0.01 to 0.5 weight %, more preferably from 0.025 to 0.25 weight %, and most preferably from 0.05 to 0.1 weight % of the wear moderating agent.

Preferably, the aliphatic groups of the wear moderating agent are substantially sulfur-free, but, in a less-preferred embodiment, the aliphatic groups groups may contain unsaturations that have been sulfurized.

Preferably, the wear moderating agent contains from 10 to 40 carbon atoms. Most preferably, it contains from 14 to 24 carbon atoms.

In one embodiment, the wear moderating agent is an aliphatic polyol ester, a boric acid derivative of an aliphatic polyol ester, or a mixture of an aliphatic polyol ester and a boric acid derivative of an aliphatic polyol ester. Preferably, the wear moderating agent is a monoester of a polyol, such as a glycerol monooleate or pentaerythritol monooleate. The wear moderating agent can also be a borated glycerol monooleate or a borated pentaerythritol monooleate.

In another embodiment, the wear moderating agent is an aliphatic amine, aliphatic polyamine, aliphatic imidazoline, or mixtures thereof. Preferably, the wear moderating agent is an aliphatic amine, such as oleyl amine, an aliphatic diamine, such as N-oleyl-1,3-propanediamine, or a 2-(aliphatic)-4,5-dihydro-1H-imidazole-1-alkanol, such as 2-(Heptadecenyl)-4,5-dihydro-1H-imidazole-1-ethanol.

In still another embodiment, the wear moderating agent is a mixture of (1) an aliphatic polyol ester, boric acid derivative thereof, or mixture thereof, and (2) an aliphatic amine, aliphatic polyamine, aliphatic imidazoline, or mixture thereof.

In one alternative embodiment, the hydraulic fluid is used in a hydraulic system containing both a piston-type pump and a vane-type pump, wherein said piston-type pump has wear surfaces containing copper or a copper alloy and the vane-type pump has wear surfaces containing steel. In that embodiment, the hydraulic fluid is drawn from a common sump.

An object of the present invention is to provide a single hydraulic pump lubricant that is useful in hydraulic systems containing both types of pumps. It is especially useful in cases where the pumps draw their lubricant from a common sump.

DETAILED DESCRIPTION OF THE INVENTION

In its broadest aspect, the present invention involves a hydraulic system containing a piston-type pump having wear surfaces containing copper or copper alloy, and, optionally, a vane-type pump having wear surfaces containing steel, using a unique antiwear hydraulic fluid. In one embodiment, the hydraulic system contains both a piston-type pump and a vane-type pump, and the hydraulic fluid is drawn from a common sump for both types of pumps.

THE PUMPS

Piston-type and vane-type pumps are well known in the art and are available from many different suppliers. Vane pumps require that the hydraulic fluid contain an antiwear agent, such as zinc dithiophosphates, to protect the vanes and cam ring, which are commonly made of steel. However, some piston pumps, for example, those made by Denison Hydraulics, employ a copper alloy on steel sliding contact which is antagonized by fluids containing such antiwear agents.

Users of hydraulic equipment desire a single fluid that can be used in both types of pumps.

The hydraulic fluid used in the present invention can be used in any of these known piston-type and vane-type pumps. Especially, it can be used in piston-type pumps having wear surfaces containing copper or a copper alloy, and in vane-type pumps having wear surfaces containing steel. These piston-type and vane-type pumps are described by Peeler in U.S. Pat. No. 4,622,157, which is hereby incorporated by reference in its entirety for all purposes.

ANTIWEAR HYDRAULIC FLUID

The antiwear hydraulic fluid used in the present invention has a major amount of an oil of lubricating viscosity, a minor amount of a metal dithiophosphate, and a minor amount of a wear moderating agent that is an aliphatic polyol ester, a boric acid derivative of an aliphatic polyol ester, an aliphatic amine, an aliphatic polyamine, an aliphatic imidazoline, or a mixture thereof.

The Oil of Lubricating Viscosity

The antiwear hydraulic fluid used in the present invention has a major amount of an oil of lubricating viscosity. That oil can be any hydrocarbon based lubricating oil or a synthetic base oil stock. It may be derived from synthetic or natural sources and may be paraffinic, naphthenic, or asphaltic base or mixtures thereof.

The oil of lubricating viscosity can be prepared from a crude mineral oil by means of physical separation methods, such as distillation, de-asphalting and dewaxing; or it may be prepared by means of chemical conversion, such as catalytic or non-catalytic hydrotreatment of mineral oil fractions; or by a combination of physical separation methods and chemical conversion; or it may be a synthetic hydrocarbon base oil. Preferably, the oil of lubricating viscosity has a kinematic viscosity of from 5 to 220 cSt at 40° C.

The Metal Dithiophosphate

The antiwear hydraulic fluid used in the present invention contains a minor amount of a metal dithiophosphate. Preferably, the metal dithiophosphate is a commercially available Group II metal dithiophosphate, where the Group II metal is preferably zinc, magnesium, calcium, or barium. Most preferably, the metal is zinc.

Metal dithiophosphates are well known extreme pressure (EP) additives and include the organic substituted metal dithiophosphates, preferably metal dihydrocarbyldithiophosphates, wherein the hydrocarbyl groups contain from three to twenty carbon atoms, preferably from four to twelve carbon atoms. Mixtures of various metal compounds can also be used, as is well known in the art. The organic substituted metal dithiophosphates contain aliphatic groups having a functional group, such as carboxy, hydroxy, carbalkoxy, and the like. The hydrocarbyl group may be either aliphatic, alicyclic, or aromatic, or mixtures thereof.

Most preferably, the metal dithiophosphate is a zinc dialkyldithiophosphate, wherein the alkyl groups contain from three to twenty carbon atoms, preferably from four to twelve carbon atoms, most preferably less than nine carbon atoms. A preferred zinc compound is a zinc dialkyldithiophosphate derived from a primary alcohol that is branched on its beta-carbon, such as di-2-ethylhexyl zinc dithiophosphate.

The metal dithiophosphate compound is generally present in a concentration of from 2 to 10 mM/kg of oil, preferably 3 to 8, more preferably 4 to 6, wherein it is assumed that there are two atoms of phosphorus and one atom of metal in each metal dithiophosphate molecule. In this method of calculation, metal dithiophosphate concentration is determined by measuring phosphorus content. This method of expressing metal dithiophosphate concentration recognizes that commercial metal dithiophosphates are commonly mixtures of neutral and basic species; thus there may be less than two atoms of phosphorus per atom of metal in the commercial material employed.

The Wear Moderating Agent

The antiwear hydraulic fluid used in the present invention also contains a minor amount of a wear moderating agent. That wear moderating agent is selected from the group consisting of:

(1) aliphatic polyol esters, boric acid derivatives thereof, and mixtures thereof;

(2) a nitrogen-containing compound selected from the group consisting of aliphatic amines, aliphatic polyamines, aliphatic imidazolines, and mixtures thereof; and (3) mixtures of (1) and (2).

For example, the wear moderating agent could be a mixture of an aliphatic polyol ester and an aliphatic imidazoline.

The aliphatic groups of the wear moderating agent are substantially straight-chained, and the wear moderating agent contains at least ten carbon atoms. The aliphatic groups may be saturated or unsaturated, and may have a minor degree of branching. The aliphatic groups can be unsubstituted, or they can be substituted with functional groups, such as carboxy, hydroxy, carbalkoxy, and the like. Preferably, the aliphatic groups are substantially sulfur-free, but, in a less-preferred embodiment, the aliphatic groups may contain unsaturations that have been sulfurized.

Preferably, the antiwear hydraulic fluid comprises from 0.01 to 0.5 weight % of the wear moderating agent. More preferably, it comprises from 0.025 to 0.25 weight % of the wear moderating agent. Most preferably, it comprises from 0.05 to 0.1 weight % of the wear moderating agent.

In one embodiment, the wear moderating agent can be an aliphatic polyol ester, the boric acid derivative of an aliphatic polyol ester, or mixtures of aliphatic polyol esters and/or their boric acid derivatives. Preferably, that wear moderating agent contains from 10 to 40 carbon atoms, more preferably from 14 to 24 carbon atoms.

The aliphatic polyol esters can be prepared by esterifying polyhydric alcohols with saturated or unsaturated monocarboxylic acids having from 6 to 30 carbon atoms, preferably from 8 to 24, provided that at least one hydroxyl group remains unesterified.

Polyhydric alcohols include ethylene glycols, including di-, tri- and tetraethylene glycols; propylene glycols, including di-, tri-, and tetrapropylene glycols; glycerol; trimethylol propane; butane diol; hexane diol; sorbitol; arabitol; mannitol; sucrose; fructose; glucose; cyclohexane diol; erythritol; and pentaerythritols, including di- and tripentaerythritol. Preferably, the polyol is glycerol, pentaerythritol, trimethylol propane, or sorbitol.

Examples of monocarboxylic acids include fatty carboxylic acids. Fatty acid esters can be prepared by a variety of methods well known in the art. Many of these esters are manufactured on a commercial scale. The esters useful for this invention are oil-soluble and are preferably prepared from $C_6$ to $C_{30}$ fatty acids or mixtures thereof, such as are found in natural products. The fatty acids may be saturated or unsaturated. Certain compounds found in acids from natural sources may include licanic acid, which contains one keto group. The preferred fatty acids are those of the formula $R_1$—COOH, wherein $R_1$ is alkyl or alkenyl. Examples of preferred fatty acids are oleic, stearic, palmitic, myristic, palmitoleic, linoleic, lauric, and eleostearic, and the acids from the natural products tallow, palm oil, olive oil, peanut oil, corn oil, neat's foot oil, and the like. Frequently, the acids are provided commerically as mixtures of one or more acids.

Specific examples of suitable esterified polyhydric alcohols include sorbitol oleates, including mono- and dioleate; sorbitol stearate, including mono- and distearate; glycerol oleate, including glycerol mono- and dioleate; and erythritol octanoate. Preferred examples include glycerol monooleate and pentaerythritol monooleate, and their borated derivatives.

Preferably, the aliphatic polyol ester is a monoester, but di- and triesters can be part of the mixture. Preferably, any mixture of mono- and diester contains at least 40 weight % of the monoester. Most preferably, mixtures of mono- and diesters contain from 40 to 60 weight % of the monoester. For example, commercial glycerol monooleate contains a mixture of from 45 to 55 weight % monoester and from 55 to 45 weight % diester.

Suitable boric acid esters are disclosed in U.S. Pat. No. 4,530,771, cited above, which is hereby incorporated in its entirety by reference for all purposes.

The boric acid esters useful in the present invention may cover a variety of compounds, which vary in structure depending on the types of reactants, the charge ratios, and the reaction conditions. They may be used singly or in combination.

When the polyol is glycerol, typical boric acid esters are compounds represented by the following formulas (I) and (II) or mixtures thereof

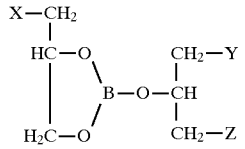

(I)

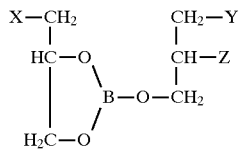

(II)

in which X, Y, and Z independently represent an OH group or a

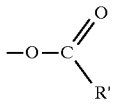

group, and R' represents a saturated or unsaturated aliphatic group having 7 to 23 carbon atoms.

The boric acid esters used in the present invention may be prepared, for example, by the following methods.

(a) Reacting polyol ester and boric acid at a temperature of 100° C. to 230° C.

(b) Reacting polyol and boric acid, and further reacting the resulting compound with carboxylic acid, lower alcohol esters of carboxylic acid, or carboxylic acid halides.

(c) Reacting mixtures of polyol, carboxylic acid triester of polyol, and boric acid at a temperature of about 240° C. to 280° C.

In an alternative embodiment, the wear moderating agent can be a nitrogen compound, such as an aliphatic amine, an aliphatic polyamine, an aliphatic imidazoline, or mixtures thereof. Preferably, the wear moderating agent contains from 10 to 40 carbon atoms, more preferably from 14 to 24 carbon atoms.

The aliphatic amine can have the general formula $R''NH_2$, wherein the R" group can be derived from a fatty acid. The preferred R" groups are those derived from the more common, naturally occurring fatty acids, including lauric acid, myristic: acid, palmitic acid, stearic acid, palmitoleic acid, oleic acid, linoleic acid, linolenic acid, eleostearic acid, and the like. Most preferably, the aliphatic amine is oleyl amine.

The aliphatic polyamine used in the present invention preferably has at least one terminal amino nitrogen atom. The aliphatic polyamine contains from 10 to 40, preferably from 14 to 24, total carbon atoms, and at least two nitrogen atoms in the molecule. In each case the amino nitrogens are separated from each other by at least two carbon atoms. The polyamine moiety of the aliphatic polyamine preferably has a carbon-to-nitrogen ratio of from about 1:1 to 2:1. At least one of the basic nitrogen atoms of the polyamine moiety should be a primary or secondary amino nitrogen. Polyamine moieties suitable for the aliphatic polyamines of this invention have been described in U.S. Pat. Nos. 4,191,537 to Lewis and Honnen and 5,413,614 to Cherpeck, which are hereby incorporated in their entirety by reference for all purposes. Preferably, the aliphatic polyamine is either an aliphatic ethylenediamine, aliphatic propanediamine, or aliphatic diethylenetriamine. A particularly preferred embodiment is N-oleyl-1,3-propanediamine.

A preferred class of nitrogen compounds are aliphatic imidazolines, as disclosed in U.S. Pat. Nos. 4,210,541 and 4,210,542, cited above. Both those patents are hereby incorporated in their entirety by reference for all purposes.

Preferably, the aliphatic imidazoline is a 2-(aliphatic)-4,5-dihydro-1H-imidazole-1-alkanol, having the general formula:

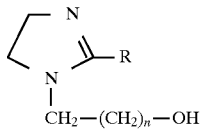

where n is an integer from 0 to 3, preferably 1, and R is an aliphatic having from 7 to 35 carbon atoms, preferably from 9 to 23 carbon atoms. Since the R group can be derived from a fatty acid in a method for preparing the compound, the preferred R groups are those derived from the more common, naturally occurring fatty acids, including lauric acid, myristic acid, palmitic acid, stearic acid, palmitoleic acid, oleic acid, linoleic acid, linolenic acid, eleostearic acid, and the like. Preferably, the aliphatic imidazoline is 2-(Heptadecenyl)-4,5-dihydro-1H-imidazole-1 -ethanol.

Generally, however, the aliphatic imidazoline will be a mixture of compounds because the naturally occurring fatty acids are most commonly available as mixtures. For example, a mixture stearic acid, palmitic acid, and oleic acid is obtained from tallow. Therefore, the aliphatic imidazoline prepared from tallow fatty acids is a mixture of compounds in which R is hexadecyl, octadecyl, and 9-octadecenyl.

Preferably, the polar group of the wear moderating agent, whether it be an ester or nitrogen-containing group, should be at the end of the aliphatic group.

Other Additives

Other additives, which are well known in the art, can be present in the antiwear hydraulic fluid used in the present invention. These additives can include, for example, antioxidants, viscosity index improvers, dispersants, detergents, rust inhibitors, demulsifiers, foam inhibitors, corrosion inhibitors, pour point depressants, and other antiwear agents. Examples of these additives are shown below:

Antioxidants: include sterically hindered alkyl phenols such as 2,6-di-t-butylphenol, 2,6-di-t-butyl-p-cresol, and 2,6-di-t-butyl-4-(2-octyl-3-propanoic) phenol; N,N-di (alkylphenyl)amines; and alkylated phenylene diamines.

Viscosity Index Improvers: include polymeric alkylmethacrylates and olefin copolymers, such as ethylene propylene copolymer or styrene butadiene copolymer.

Dispersants: include hydrocarbyl succinimides, succinic acid esters, or benzylamines, where the hydrocarbyl group is an alkyl or alkenyl group with a molecular weight of about 700 to 3000. These compounds may be further reacted with boric acid.

Detergents: include calcium alkyl salicylates and calcium alkyl phenates.

Rust Inhibitors: include alkenyl succinic acids, their partial esters, and their nitrogen derivatives; and synthetic alkyl aryl sulfonates, such as metal dinonylnaphthalene sulfonates.

Demulsifiers: include alkoxylated phenols and phenol formaldehyde resins and synthetic alkyl aryl sulfonates, such as metal dinonylnaphthalene sulfonates.

Foam Inhibitors: include alkyl methacrylate polymers and dimethyl silicone polymers.

Corrosion Inhibitors: include 2,5-dimercapto-1,3,4-thiadiazoles and derivatives, mercaptobenzothiazoles, alkyltriazoles, and benzotriazoles Pour Point Depressants: include polymethacrylates.

Other Antiwear Agents: include aryl phosphates and phosphites, sulfurized esters, and sulfur-phosphorus compounds.

In one embodiment, the antiwear hydraulic fluid used in the present invention can be produced by blending an oil of lubricating viscosity, metal dithiophosphate, wear moderating agent, and other additives. In another embodiment, the antiwear hydraulic fluid can be produced by blending the metal dithiophosphate, wear moderating agent, and other additives, with a small amount of a diluent oil, such as kerosine, diesel fuel, or an aromatic solvent, to give a concentrated additive solution and the concentrated additive solution can be blended with an oil of lubricating viscosity. Because the components may interact, the hydraulic fluid may contain one or more complexes or reaction products of the various components, together with unreacted components.

EXAMPLES

The invention will be further illustrated by the following examples, which set forth particularly advantageous method embodiments. While the examples are provided to illustrate the present invention, they are not intended to limit it.

Comparative Example A

A base additive package containing a mixture of di-2-ethylhexyl zinc dithiophosphate and functional amounts of calcium detergents, rust inhibitor, demulsifiers, antioxidant, and foam inhibitor additives was blended into a paraffinic base oil, so that the base additive package constituted 0.80 weight % of the finished oil blend. The finished oil blend had a kinematic viscosity at 40° C. of about 46 cSt.

Example 1

To the finished oil of Comparative Example A was added 0.05 weight % of a commercial glycerol monooleate.

Comparative Example B

In a solvent refined paraffinic base oil was blended 4 mM/kg of a commercial zinc dithiophosphate and 2 mM/kg of an overbased calcium phenate. The finished oil blend had a kinematic viscosity at 40° C. of about 46 cSt.

Example 2

To the finished oil of Comparative Example B was added 0.10 weight % of a commercial glycerol monooleate.

Comparative Example C

A commercial antiwear hydraulic oil base additive package, containing a mixture of di-2-ethylhexyl zinc dithiophosphate and functional amounts of calcium detergent, rust inhibitor, demulsifier, antioxidant, and foam inhibitor additives, was blended into a solvent refined paraffinic base oil, so that the base additive package constituted 1.13 weight % of the finished oil blend. The finished oil blend had a kinematic viscosity at 40° C. of about 46 cSt.

Example 3

To the finished oil of Comparative Example C was added 0.10 weight % of a borated glycerol monooleate.

Example 4

To the finished oil of Comparative Example C was added 0.10 weight % of a commercial N-oleyl-1,3-propanediamine.

Comparative Example D

In a solvent refined paraffinic base oil was blended 8 mM/kg of a commercial zinc dithiophosphate from Chevron Chemical Company and 3 mM/kg of an overbased calcium phenate from Chevron Chemical Company. The finished oil blend had a kinematic viscosity at 40° C. of about 46 cSt.

Example 5

To the finished oil of Comparative Example D was added 0.10 weight % of a commercial N-oleyl-1,3-propanediamine.

Example 6

To the finished oil of Comparative Example D was added 0.05 weight % of a commercial 2-(Heptadecenyl)-4,5-dihydro-1H-imidazole-1 -ethanol.

Example 7

To the finished oil of Comparative Example D was added 0.10 weight % of a commercial pentaerythritol monooleate.

Example 8

To the finished oil of Comparative Example D was added 0.10 weight % of a commercial sorbitan monooleate.

Example 9

To the finished oil of Comparative Example D was added 0.50 weight % of a commercial oleyl amine.

The above examples were evaluated in a laboratory pump test apparatus. The test pump used for this evaluation was a model P46 axial piston pump manufactured by Denison Hydraulics, Marysville, Ohio. After a short break-in, the pump was operated with the working loop pressure maintained at 5000±100 psi. The P46 inlet temperature was controlled for 60 hours at 160°±10° F., followed by 40 hours at 210°±10° F. Pump parts were then examined for surface distress. Damage to the faceplate or port plate, or excessive scoring of the piston shoes and/or transfer of brass to the creep plate were regarded as failures.

The following table summarizes the test results.

| Oil From Example | Pump Test Result |
|---|---|
| A | Borderline Fail* |
| 1 | Pass |
| B | Fail |
| 2 | Pass |
| C | Fail |
| 3 | Pass |
| 4 | Pass |
| D | Fail |
| 5 | Pass |
| 6 | Pass |
| 7 | Borderline Fail* |
| 8 | Borderline Fail* |
| 9 | Pass |

Borderline fail means that some, but not all, of the criteria of a pass were met.

While the present invention has been described with reference to specific embodiments, this application is intended to cover those various changes and substitutions that may be made by those skilled in the art without departing from the spirit and scope of the appended claims.

What is claimed is:

1. In a hydraulic system containing a piston-type pump having wear surfaces containing copper or a copper alloy, and a vane-type pump having wear surfaces containing steel, the improvement comprising using, in said hydraulic system, an anti-wear hydraulic fluid useful in both types of pumps, said anti-wear hydraulic fluid comprising:

(a) a major amount of an oil of lubricating viscosity;

(b) a minor amount of at least one metal dithiophosphate; and (c) a minor amount of a wear moderating agent selected from the group consisting of:

(1) aliphatic polyol esters, boric acid derivatives thereof, and mixtures thereof;

(2) a nitrogen-containing compound selected from the group consisting of aliphatic amines, aliphatic polyamines, and mixtures thereof; and (3) mixtures of (1) and (2);

wherein the aliphatic groups are substantially straight-chained, and wherein the wear moderating agent contains at least ten carbon atoms.

2. A hydraulic system according to claim 1 wherein the metal dithiophosphate is a zinc dialkyldithiophosphate, wherein the alkyl groups of the zinc dialkyldithiophosphate contain less than nine carbon atoms, and wherein said antiwear hydraulic fluid comprises from 2 to 10 mM/kg of said zinc dithiophosphate.

3. A hydraulic system according to claim 2 wherein the zinc dialkyldithiophosphate is derived from a primary alcohol that is branched on its beta-carbon, and wherein said antiwear hydraulic fluid comprises from 4 to 6 mM/kg of said zinc dithiophosphate.

4. A hydraulic system according to claim 3 wherein the zinc dialkyldithiophosphate is di-2-ethylhexyl zinc dithiophosphate.

5. A hydraulic system according to claim 1 wherein said antiwear hydraulic fluid comprises from 0.05 to 0.1 weight % of said wear moderating agent.

6. A hydraulic system according to claim 1 wherein the aliphatic groups of said wear moderating agent are substantially sulfur-free.

7. A hydraulic system according to claim 1 wherein the wear moderating agent contains from 10 to 40 carbon atoms.

8. A hydraulic system according to claim 1 wherein the wear moderating agent is selected from the group consisting of aliphatic polyol esters, boric acid derivatives thereof, and mixtures thereof.

9. A hydraulic system according to claim 8 wherein said wear moderating agent is either a monoester of a polyol or a borated derivative thereof.

10. A hydraulic system according to claim 9 wherein said wear moderating agent is selected from the group consisting of a glycerol monooleate, a borated glycerol monooleate, a pentaerythritol monooleate, and a borated pentaerythritol monooleate.

11. A hydraulic system according to claim 1 wherein the wear moderating agent is selected from the group consisting of aliphatic amines, aliphatic polyamines, and mixtures thereof.

12. A hydraulic system according to claim 11 wherein the wear moderating agent is oleyl amine.

13. A hydraulic system according to claim 11 wherein said wear moderating agent is N-oleyl-1,3-propanediamine.

14. A hydraulic system according to claim 1 wherein there is a common sump for use in both types of pumps, and wherein said anti-wear hydraulic fluid is used in said common sump.

15. In a hydraulic system containing a piston-type pump having wear surfaces containing copper or a copper alloy, and a vane-type pump having wear surfaces containing steel, the improvement comprising using, in said hydraulic system, an anti-wear hydraulic fluid useful in both types of pumps, wherein said anti-wear hydraulic fluid is produced by the method comprising blending the following components:

(a) a major amount of an oil of lubricating viscosity;

(b) a minor amount of at least one metal dithiophosphate; and (c) a minor amount of a wear moderating agent selected from the group consisting of:

(1) aliphatic polyol esters, boric acid derivatives thereof, and mixtures thereof;

(2) a nitrogen-containing compound selected from the group consisting of aliphatic amines, aliphatic polyamines, and mixtures thereof; and (3) mixtures of (1) and (2);

wherein the aliphatic groups are substantially straight-chained, and wherein the wear moderating agent contains at least ten carbon atoms.

16. In a hydraulic system containing a piston-type pump having wear surfaces containing copper or a copper alloy, and a vane-type pump having wear surfaces containing steel, the improvement comprising using, in said hydraulic system, an anti-wear hydraulic fluid useful in both types of pumps, wherein said anti-wear hydraulic fluid is produced by the method comprising (a) blending the following components to form a concentrate:

(1) a minor amount of a diluent oil;

(2) at least one metal dithiophosphate; and (3) a wear moderating agent selected from the group consisting of:

(i) aliphatic polyol esters, boric acid derivatives thereof, and mixtures thereof;

(ii) a nitrogen-containing compound selected from the group consisting of aliphatic amines, aliphatic polyamines, and mixtures thereof; and (iii) mixtures of (i) and (ii);

wherein the aliphatic groups are substantially straight-chained, and wherein the wear moderating agent contains at least ten carbon atoms; and (b) blending the concentrate formed in the step (a) with a major amount of an oil of lubricating viscosity.

* * * * *